United States Patent [19]

Benno

[11] Patent Number: 4,754,879

[45] Date of Patent: Jul. 5, 1988

[54] MULTIPACKAGE OF CONTAINERS IN A TRAY

[76] Inventor: Edward L. Benno, 17960 W Hwy. 120, Grayslake, Ill. 60030

[21] Appl. No.: 56,244

[22] Filed: Jun. 1, 1987

[51] Int. Cl.[4] ..... B65D 75/00

[52] U.S. Cl. ..... 206/432; 206/200; 206/427; 229/52 B; 229/52 BC

[58] Field of Search ..... 206/139, 200, 427, 429, 206/432, 497; 229/52 B, 52 BC, 190; 53/399, 398, 441

[56] References Cited

U.S. PATENT DOCUMENTS

| | | | |
|---|---|---|---|
| 3,353,326 | 11/1967 | Becker | 206/497 |
| 3,425,544 | 2/1969 | Ayer et al. | 229/52 B |
| 3,488,913 | 1/1970 | Burgess | 206/432 |
| 3,600,872 | 8/1971 | Sharpnack, Jr. | 206/432 |
| 4,094,406 | 6/1978 | Zietzschmann | 206/497 |
| 4,184,595 | 1/1980 | Wackerman | 229/52 BC |
| 4,454,705 | 6/1984 | Benno | 53/398 |
| 4,471,870 | 9/1984 | Uhlig | 229/52 B |
| 4,530,459 | 7/1985 | Maroszek | 229/52 B |

FOREIGN PATENT DOCUMENTS

| | | | |
|---|---|---|---|
| 2159258 | 6/1973 | Fed. Rep. of Germany | 229/52 B |

*Primary Examiner*—David T. Fidei
*Attorney, Agent, or Firm*—Edward L. Benno

[57] ABSTRACT

A package of a tray carrying relatively heavy objects such as an array of beverage cans, and a tube securely circumferentially applied about the tray. The tray has end walls that extend to the tops of the objects in the tray and the upper portions of the end walls are foldable outwardly away from the objects and have hand holds. The ends of the tube securely lap over the tops of the end ranks of objects. That arrangement permits the tray to be carried in a depending hanging condition from either upper end wall portion without having the objects fall from the tray.

9 Claims, 1 Drawing Sheet

MULTIPACKAGE OF CONTAINERS IN A TRAY

BACKGROUND OF THE INVENTION

This invention relates to packages of the type generally comprising a shallow paperboard tray containing a number of identical generally cylindrical objects such as cans or bottles of beverages such as beer or soda, and encircled by a thin plastics material tube or wrap.

Generally, such packages although of considerable weight, are not provided with handles for more convenient carrying of the package when it is intended to be a retail package that a person would buy at a grocery store. Handles are often omitted because of excessive costs, or because they are difficult to add, or because the package may not securely contain the packaged objects in all of the possible handle carrying modes.

SUMMARY OF THE INVENTION

The subject invention provides a low cost, convenient, and secure carrying and holding arrangement in all handle carrying modes for the packages objects in a shallow tray containing a plurality of generally cyclindrical objects such as beverage cans or bottles and encircled by a thin plastics material band or tube and wherein the package is of considerable weight.

The arrangement is particularly appropriate for retail type packages where maximum exposure of the objects in the package is desired and where persons of greatly different physical strength and ability are likely to carry the packages.

Briefly, the arrangement of the invention involves the extension of the integral end walls of the paperboard tray to about the tops of the objects carried in the tray, the reduction of the height of the side walls to a minimum, the provision of a fold line across the end walls at or above the junction with the side walls, the provision of hand holds in the end walls above the fold lines, and the construction of the film band or tube with end portions securely lapping over the upper ends of the end ranks of objects between the end walls.

In that arrangement, the packaged objects are easily observed through the plastic film along the side walls, the package can be easily carried by a person grasping the hand holds at each end of the tray, and most importantly, the package can be carried in a convenient depending condition from the hand hold at one end of the try a without dropping some of the objects from the package. In the depending carrying position of the package, the side-wall-to-lower-end-wall connection keeps the lower ends of the objects in the tray, and the overlap of the film tube keeps the upper ends of the objects in the tray.

DETAILED DESCRIPTION OF THE DRAWING

DETAILED DESCRIPTION OF THE INVENTION

Figure 1:
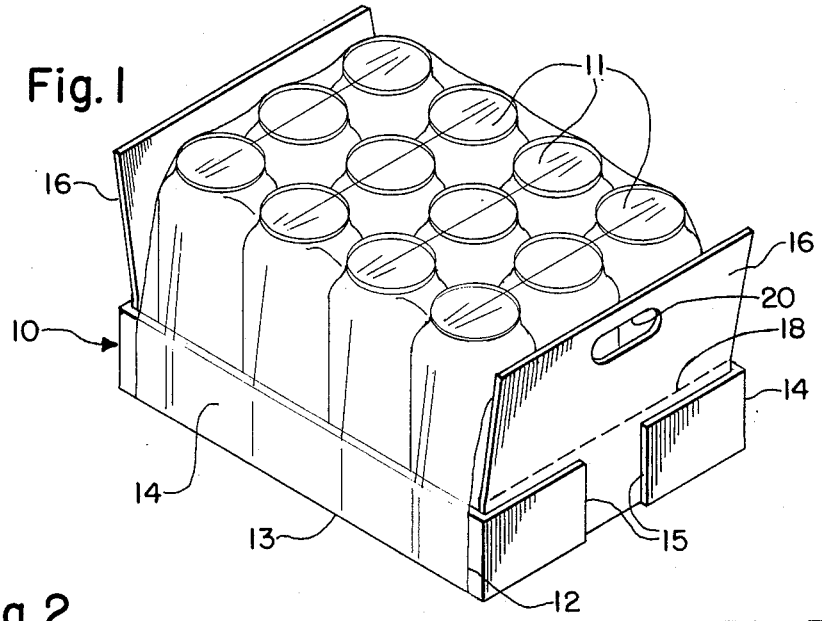
FIG. 1 is an isometric view of a preferred embodiment of the invention.
Figure 2:
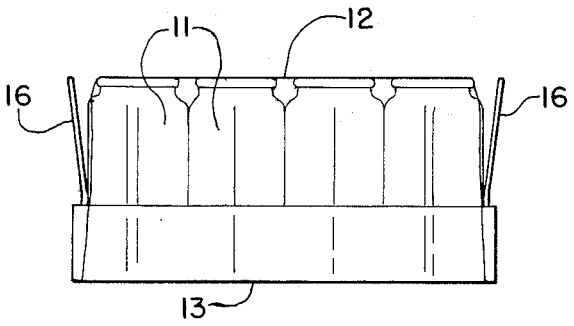
FIG. 2 is a side elevational view of the structure of FIG. 1.

In a preferred embodiment shown in FIG. 1, the package comprises a tray 10, a plurality of objects 11, and a film tube 12.

The tray 10 is preferably formed from a single blank of corrugated paperboard. After the blank is cut, the side walls and end walls are folded to upstand from the bottom wall and secured together as an upstanding paperboard band about the periphery of the bottom wall. The bottom wall 13 is rectangular and carries the plurality of objects 11 thereon in a rectangular array the periphery of which closely coincides with the periphery of the bottom wall 13.

As shown in FIG. 1, the side walls 14 are integral with and upstand from two opposed edges of the bottom wall 13 to define a shallow U-shaped section. In the preferred embodiment of FIGS. 1–5, the ends of the side walls 14 are provided with extensions 15 which are folded over the lower outer face of the end walls 16 and secured thereto as with an adhesive or staples.

The end walls 16 are integrally formed on the other two opposed edges of the bottom wall 13. As may be seen from the drawing, the extensions 15 hold at least the lower portions of the end walls 16 upright and against the end ranks of objects 11. The invention contemplates that the connections between the lower portions of the end walls 16 and the U-shaped section of the side walls 14 and bottom wall 13 can take alternative forms. For example, the extensions 15 can be integrally formed on the end walls 16 and folded over the side walls 14.

In the embodiments of FIGS. 1–5, the side walls 14 have a height less than the vertical midpoint height of the objects 11. To achieve maximum exposure of the outer side rows of the objects 11, the side walls can be lowered further, such as side walls 17 of FIG. 6. In that embodiment of the tray, the end portions of the side walls 17 have gusset-like end sections integral with the extensions 15 folded over the secured to the lower portions of the end walls 16. The upper portions of the end walls 16 in FIG. 6, and to a lesser or greater extent in the other views, are shown as angled outwardly. That showing is merely to emphasize that the upper portions of the end walls 16 must be free of any restriction against outward folding or bending.

Figure 3:
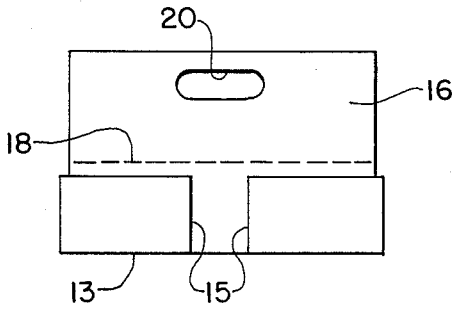
FIG. 3 is an end elevational view of the structure of FIG. 1.
Figure 5:
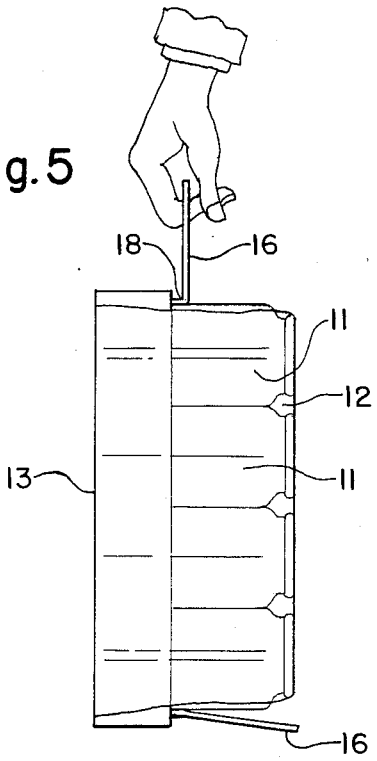
FIG. 5 is a side elevational view of the structure of FIGS. 1–4 showing the package in a depending carrying mode; and, FIG. 6 is a side elevational view of another embodiment of the tray portion of the package of the invention.
Figure 6:
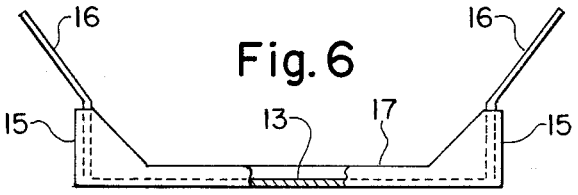

The tray 10 further comprises fold lines 18 formed in the end walls 16 at or above any connections with the side walls 14 and extending transversely thereacross as may be seen in FIGS. 1 and 3. The purpose of the fold lines 18 is to enable a person to fold the upper portion of either end wall 16 outwardly away from the end ranks of objects 11. That facility permits easy grasping and holding of the upper portion of an end wall 16. The fold lines 18 can be made in various ways depending upon the character and construction of the material of the tray 10. One contemplated form is to impress the fold line in the tray material with a die. A preferred height location for the fold lines 18 is that which will result in an almost vertical hanging alignment of the tray 10 when it is held by the upper portion of one of the end walls 16 as shown in FIG. 5. Between the fold lines 18 and the upper edge of the upper portion of each end wall 16, a hand hold 20 is provided.

The objects 11 are cans with their upper ends necked-in. The objects 11 can also be bottles aligned to abut each other in rows and ranks in a rectangular pattern. Although the drawing shows twelve cans 11, the invention contemplates other numbers such as twenty four.

Figure 4:
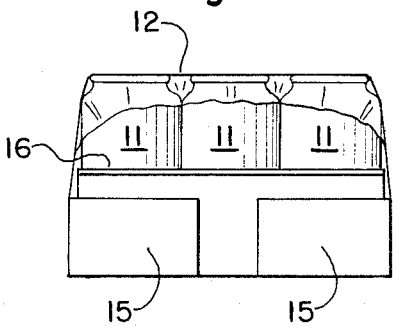
FIG. 4 is a view like that of FIG. 3 but with the upper portion of the end wall facing the viewer folded down to a horizontal position.

The film tube 12 in a preferred embodiment is a highly stretched and tensioned tube of an elastic resilient plastics material such as linear low density polyethylene. In a preferred form it has an initial unstretched circumferential dimension of at least 30% less than the circumferential dimension about the bottom wall 13, the side walls 14, and the sides and top of the objects 11. Importantly, the initial length of the tube in the unstretched condition must be such that when the tube is stretched, applied about the U-shaped section of the bottom wall 13 and side walls 14, and the sides and top of the objects 11, and released thereabout in a tensioned condition, the end portions of the tube 12 over the tops of the end ranks of objects 11 will lap over those tops in a secure object holding arrangement. Such a tube can be applied by following the teachings in U.S. Pat. No. 4,454,705. In the application of the tube care must be taken not to overlap the upper edges of the upper portions of the end walls 16 and thereby trap the upper portion of the end wall against folding. In one reduction to practice of the invention, the objects were 12 ounce cans of a beverage, the tray dimensions were a length of 10 and ⅞ inches—a width of 8 inches—a side wall height of 2 inches—an end wall height of 5 inches, and the tube hand an initial circumference of 20 inches and an initial length of 12 and ½ inches. The ends of the tube in the applied condition then lapped over the upper ends of the cans such as shown in FIG. 4 in a condition of decreasing tension to the marginal edge of the tube. In that arrangement, the package could obviously be carried by a person with two hands grasping the opposite ends of the package, but more importantly a person with one hand could fold the end wall 16 horizontally as shown in FIG. 4, grasp the hand hold 20 in that end wall and lift or draw the package from its resting place to carry it. The package then assumes the depending condition shown in FIG. 5 with a person's hand conveniently holding the package. In the carrying mode of FIG. 5, it was found in the described reduction to practice that the tops of the lowest rank of cans were securely held by the lower lapped tube end while the bottoms of the lowest rank of cans were held by the portion of the lower end wall secured to the side and bottom walls. The other ranks of cans of course rest upon the lowest rank and are held in the hanging tray by the tube.

The invention contemplates that in the alternative the tube 12 can be made from a web of shrink film. The web is wrapped about the bottom wall 13, the side walls 14, and the sides and tops of the objects 11. The web is then sealed into a relatively loose tube with substantial end portions of the tube extending beyond the end ranks of objects 11. Conveniently, the upper portions of the end walls 16 can be folded out of the way of the projecting shrink film tube while the tube is heated to shrink the film against the objects 11 and particularly the tops of the end ranks of objects 11. After cooling when the shrink film returns to its crystalline state, the package can be carried as described above for the stretch tube embodiment.

Having described the invention, it is to be understood that changes can be made in the described embodiments by a person skilled in the art within the spirit and scope of the claims.

I claim:

1. In a package for a plurality of generally cylindrical objects wherein said package comprises a paperboard tray carrying said plurality of objects in a rectangular array and a thin plastics tube encircling the bottom of said tray and two sides and the top of said array, the improvement comprising, said tray having a bottom wall portion of a rectangular shape closely conforming to the periphery of said array and supporting said objects thereon and side wall portions extending upwardly from opposed sides of said bottom wall portion along said two sides of said array to define a U-shaped section of said tray, said tray further having two opposed end walls upwardly extending and integral with the other opposed sides of said bottom wall portion of said U-shaped section, at least one of said end walls having a fold line extending parallel to said bottom wall portion between the upper and lower edges of said one end wall enabling the upper portion of said one end wall to be folded outwardly away from said array to positions generally parallel to said bottom wall portion, a hand hold formed in said upper portion of said one end wall to enable a person to grasp and hold said upper portion of said one end wall, said thin plastics tube being formed to securely conform in encircling engagement of said U-shaped section and said two sides and said top of said array, said tube further being formed with opposed end portions to securely lap over the upper ends of said other two sides of said array and inwardly of said end walls to an extent holding said upper ends of said array against falling of any of said objects from said array when a person grasps and holds said upper portion of said one end wall by said hand hold with the remaider of said tray in a depending hanging condition.

2. In a package as defined in claim 1, said tube further being formed with opposed end portions to securely lap over the upper ends of said other two sides of said array comprising said thin plastics tube being formed of an elastic resilient plastics material and of an initial circumferential dimension substantially smaller than the circumferential dimension about said bottom of said tray and said two sides and said top of said array, and said tube being applied in a stretched condition encircling said bottom of said tray and said two sides and said top of said array with said opposed end portions of said tube lapping over the upper ends of said other two sides of said array in conditions of decreasing stretched patterns to the end edges of said opposed end portions of said tube.

3. In a package as defined in claim 1, said tube further being formed with opposed end portions to securely lap over the upper ends of said other two sides of said array comprising said thin plastics tube being formed of a plastics material having the property of shrinking in area upon being heated and substantially maintaining the shrunk condition upon thereafter being cooled, and said tube being further formed with opposed end portions to securely lap over the upper ends of said other two sides of said array comprising said opposed end portions having been heated sufficiently to securely lap over the upper ends of said other two sides of said array in a shrunk condition.

4. In a package as defined in claim 1, the other of said end walls having a fold line extending parallel to said bottom wall portion between the upper and lower edges of said other end wall enabling the upper portion of said other end wall to be folded outwardly away from said array, a hand hold formed in said upper portion of said other end wall to enable a person to grasp and hold said upper portion of said other end wall.

5. In a package as defined in claim 4, said end walls having a height substantially the height of said objects.

6. In a package as defined in claim 5, said side wall portions of said U-shaped section having a height less than the vertical midpoint height of said objects and being secured to said end walls.

7. In a package as defined in claim 6, said fold lines of said one end wall and said other end wall being formed to have a height substantially the height of said side wall portions.

8. In a package as defined in claim 6, said fold lines of said one end wall and said other end wall being formed to have a height substantially greater than the height of said side wall portions.

9. In a package as defined in claim 5, said side wall portions of said U-shaped section being shaped with gussetlike end portions secured to said end walls below said fold lines, and the portions of said side wall portions between said gusset-like end portions being formed of a height substantially less than the maximum height of said gussetlike end portions.

* * * * *